US009279420B2

(12) United States Patent
Moore et al.

(10) Patent No.: US 9,279,420 B2
(45) Date of Patent: Mar. 8, 2016

(54) NATURAL GAS COMPRESSOR

(71) Applicant: INTELLECTUAL PROPERTY HOLDINGS, LLC, Cleveland, OH (US)

(72) Inventors: Dan T. Moore, Cleveland Heights, OH (US); Martin Dorociak, Olmsted Falls, OH (US); Matt Raplenovich, Avon Lake, OH (US); Michael Mahar, Cleveland, OH (US); Bradley Trembath, Shaker Heights, OH (US)

(73) Assignee: INTELLECTUAL PROPERTY HOLDINGS, LLC, Cleveland, OH (US)

( * ) Notice: Subject to any disclaimer, the term of this patent is extended or adjusted under 35 U.S.C. 154(b) by 10 days.

(21) Appl. No.: 14/290,344

(22) Filed: May 29, 2014

(65) Prior Publication Data

US 2014/0356196 A1 Dec. 4, 2014

Related U.S. Application Data

(60) Provisional application No. 61/829,692, filed on May 31, 2013, provisional application No. 61/836,429, filed on Jun. 18, 2013, provisional application No. 61/847,619, filed on Jul. 18, 2013, provisional application No. 61/872,136, filed on Aug. 30, 2013, provisional application No. 61/948,168, filed on Mar. 5, 2014.

(51) Int. Cl.
*F04B 25/02* (2006.01)
*F04B 15/00* (2006.01)
(Continued)

(52) U.S. Cl.
CPC ..... *F04B 27/04* (2013.01); *F04B 25/00* (2013.01); *F04B 39/06* (2013.01); *F04B 49/08* (2013.01); *F04B 49/103* (2013.01); *F04B 2203/0209* (2013.01)

(58) Field of Classification Search
CPC .. F04B 2203/0209; F04B 27/04; F04B 39/06; F04B 49/08; F04B 49/103; F04B 25/04; F04B 27/0409
USPC ..... 417/243–269
See application file for complete search history.

(56) References Cited

U.S. PATENT DOCUMENTS 1,880,299 A 10/1932 Tebault
2,049,239 A 7/1936 Wilcox
(Continued)

FOREIGN PATENT DOCUMENTS

CN 102155382 B1 11/2012
DE 19927518 A1 1/2001
(Continued)

OTHER PUBLICATIONS

International Search Report from PCT/US2014/039975 mailed Oct. 16, 2014.

*Primary Examiner* — Peter J Bertheaud
*Assistant Examiner* — Dominick L Plakkoottam
(74) *Attorney, Agent, or Firm* — Calfee, Halter & Griswold LLP

(57) ABSTRACT

The present application discloses a natural gas compressor, a natural gas compressor assembly, a system for compressing natural gas, and a method of compressing natural gas. In certain embodiments, the natural gas compressor comprises a housing, a plurality of cylinder piston assemblies disposed within the housing, and a drive system for moving the pistons of the cylinder piston assemblies to compress natural gas within the cylinders of the assemblies. Each cylinder piston assembly comprises a piston for compressing natural gas within a cylinder of the assembly. The plurality of cylinder piston assemblies are fluidly connected in sequence such that each assembly forms a compression stage of the compressor.

27 Claims, 12 Drawing Sheets

(51) Int. Cl.

| | |
|---|---|
| ***F04B 39/06*** | (2006.01) |
| ***F04B 27/04*** | (2006.01) |
| ***F04B 25/00*** | (2006.01) |
| ***F04B 49/08*** | (2006.01) |
| ***F04B 49/10*** | (2006.01) |

(56) References Cited

U.S. PATENT DOCUMENTS

| | | | | | |
|---|---|---|---|---|---|
| 2,136,738 | A | | 11/1938 | Giordano | |
| 2,141,057 | A | * | 12/1938 | Whiles | F04B 25/00 417/248 |
| 2,182,126 | A | | 12/1939 | Hogarth | |
| 2,276,839 | A | | 3/1942 | Grise | |
| 2,864,242 | A | | 12/1958 | Muller | |
| 2,985,305 | A | | 7/1959 | Nock et al. | |
| 3,101,171 | A | | 8/1963 | Fraser | |
| 3,603,480 | A | | 9/1971 | Irie et al. | |
| 3,693,463 | A | * | 9/1972 | Garman | F02B 75/048 123/197.3 |
| 4,082,122 | A | | 4/1978 | McGahey | |
| 4,195,674 | A | | 4/1980 | Madden | |
| 4,202,385 | A | | 5/1980 | Voelz et al. | |
| 4,223,706 | A | | 9/1980 | McGahey | |
| 4,252,161 | A | | 2/1981 | Krupp | |
| 4,306,844 | A | | 12/1981 | Otto et al. | |
| 4,360,127 | A | | 11/1982 | Maruyama et al. | |
| 4,501,253 | A | | 2/1985 | Gerstmann et al. | |
| 4,515,516 | A | | 5/1985 | Perrine et al. | |
| 4,780,063 | A | | 10/1988 | Tuckey | |
| 5,033,940 | A | | 7/1991 | Baumann | |
| 5,114,046 | A | | 5/1992 | Bryant | |
| 5,163,409 | A | | 11/1992 | Gustafson et al. | |
| 5,179,922 | A | | 1/1993 | Bartholomew | |
| 5,330,031 | A | | 7/1994 | Hill et al. | |
| 5,351,726 | A | | 10/1994 | Diggins | |
| 5,400,924 | A | | 3/1995 | Brodie | |
| 5,501,200 | A | | 3/1996 | Bogartz | |
| 5,586,050 | A | | 12/1996 | Makel et al. | |
| 5,623,907 | A | | 4/1997 | Cotton et al. | |
| 5,630,528 | A | | 5/1997 | Nanaji | |
| 5,636,667 | A | | 6/1997 | Young | |
| 5,653,269 | A | | 8/1997 | Miller | |
| 5,692,647 | A | | 12/1997 | Brodie | |
| 5,694,985 | A | | 12/1997 | Diggins | |
| 5,711,456 | A | | 1/1998 | Bryant | |
| 5,727,765 | A | | 3/1998 | Alvem | |
| 5,850,856 | A | | 12/1998 | Olson | |
| 5,865,346 | A | | 2/1999 | Del Zotto | |
| 5,957,667 | A | | 9/1999 | Epp | |
| 5,975,371 | A | | 11/1999 | Webb | |
| 5,988,439 | A | | 11/1999 | Webb | |
| 6,085,805 | A | | 7/2000 | Bates | |
| 6,152,197 | A | | 11/2000 | Gerardot | |
| 6,179,163 | B1 | | 1/2001 | Bohr | |
| 6,336,479 | B1 | | 1/2002 | Nanaji | |
| 6,425,377 | B1 | | 7/2002 | Marx et al. | |
| 6,547,534 | B1 | | 4/2003 | Sakamoto et al. | |
| 6,568,911 | B1 | | 5/2003 | Brightwell et al. | |
| 6,626,646 | B2 | | 9/2003 | Rajewski | |
| 6,640,997 | B1 | | 11/2003 | Anderson | |
| 6,732,769 | B2 | | 5/2004 | Del Campo | |
| 6,899,115 | B1 | | 5/2005 | Adler | |
| 7,011,118 | B2 | | 3/2006 | Chan et al. | |
| 7,082,751 | B2 | | 8/2006 | McCulloch | |
| 7,201,151 | B2 | | 4/2007 | Hayakawa | |
| 7,306,715 | B2 | | 12/2007 | Kata et al. | |
| 7,455,041 | B2 | * | 11/2008 | Meyer | F02B 75/048 123/197.4 |
| 7,753,148 | B2 | | 7/2010 | Kokot et al. | |
| 7,806,108 | B2 | | 10/2010 | Eck | |
| 8,062,003 | B2 | * | 11/2011 | Goertzen | A61M 16/10 417/269 |
| 2003/0077181 | A1 | | 4/2003 | Rajewski | |
| 2007/0107700 | A1 | | 5/2007 | Milton et al. | |
| 2009/0314384 | A1 | | 12/2009 | Brakefield et al. | |
| 2010/0111713 | A1 | * | 5/2010 | Chatfield | F04B 39/0055 417/53 |
| 2013/0218484 | A1 | * | 8/2013 | Kar | G01K 13/08 702/36 |

FOREIGN PATENT DOCUMENTS

| | | | |
|---|---|---|---|
| DE | 10213004 | A1 | 10/2003 |
| EP | 211115 | A1 | 2/1987 |
| FR | 2580778 | A1 | 10/1986 |
| GB | 909681 | A | 10/1962 |
| GB | 1378473 | A | 12/1974 |
| GB | 1412460 | A | 11/1975 |
| GB | 1418326 | A | 12/1975 |
| GB | 1551714 | A | 8/1979 |
| GB | 2260755 | A | 4/1993 |
| GB | 2298900 | A | 9/1996 |
| GB | 2371029 | A | 7/2002 |
| JP | 55068425 | A | 5/1980 |
| JP | 56152226 | A | 12/1981 |
| WO | 9204609 | | 3/1992 |
| WO | 0140104 | | 6/2001 |
| WO | 02101238 | | 12/2002 |
| WO | 2008046229 | | 4/2008 |
| WO | 2009112500 | A1 | 9/2009 |

* cited by examiner

NATURAL GAS COMPRESSOR

CROSS REFERENCE TO RELATED APPLICATIONS

This application is a U.S. Non-Provisional patent application which claims priority to U.S. Provisional Patent Application No. 61/829,692, filed on May 31, 2013 and titled "Vehicle Natural Gas Compressor", U.S. Provisional Patent Application No. 61/836,429, filed Jun. 18, 2013 and titled "Vehicle Natural Gas Compressor", U.S. Provisional Patent Application No. 61/847,619, filed Jul. 18, 2013 and titled "Natural Gas Compressor", U.S. Provisional Patent Application No. 61/872,136, filed Aug. 30, 2013 and titled "Natural Gas Compressor", and U.S. Provisional Patent Application No. 61/948,168, filed on Mar. 5, 2014 and titled "Natural Gas Compressor", all of which are hereby incorporated by reference in their entirety.

BACKGROUND

Natural gas compressors for refueling vehicles are often too large to be installed within an automobile and may introduce lubricants such as oil or grease into the compressed gas which may harm the vehicle. Such compressors also often require significant service and maintenance, sometimes as often as every 8 hours. Further, the product life cycles of these compressors are often short as major service is required to overhaul complicated cranks, yokes, and sliders within the compressor that wear or fail.

SUMMARY

The present application discloses a natural gas compressor, a natural gas compressor assembly, a system for compressing natural gas, and a method of compressing natural gas.

In certain embodiments, the natural gas compressor comprises a housing, a plurality of cylinder piston assemblies disposed within the housing, and a drive system for moving the pistons of the cylinder piston assemblies to compress natural gas within the cylinders of the assemblies. Each assembly comprises a non-lubricated piston for compressing natural gas within a cylinder of the assembly. The plurality of cylinder piston assemblies are fluidly connected in sequence such that each assembly forms a compression stage of the compressor. The pressure of compressed natural gas exiting the last cylinder piston assembly of the compressor is between about 2000 and 5000 psi when a drive shaft of the drive system is rotating between about 50 and 500 RPM.

In certain embodiments, the natural gas compressor assembly comprises a motor, a torque multiplier connected to the motor, a natural gas compressor having a drive shaft connected to the torque multiplier, and an intercooler that cools the natural gas between the compression stages of the compressor. The natural gas compressor comprises a housing, a plurality of cylinder piston assemblies disposed within the housing, a water jacket having at least one conduit that cools the cylinder piston assemblies, and a drive system for moving the pistons of the cylinder piston assemblies to compress natural gas within the cylinders of the assemblies. Each cylinder piston assembly comprises a movable and non-lubricated piston for compressing natural gas within a cylinder of the assembly. The plurality of cylinder piston assemblies are fluidly connected in sequence such that each assembly forms a compression stage of the compressor. The intercooler comprises a tank and a plurality of conduits in fluid communication with the cylinder piston assemblies. In certain embodiments, a natural gas compression system comprises a natural gas compressor assembly and a compressed natural gas storage tank fluidly connected to the natural gas compressor of the assembly.

These and additional embodiments will become apparent in the course of the following detailed description.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of the inventions.

DESCRIPTION OF EMBODIMENTS

Figure 1:
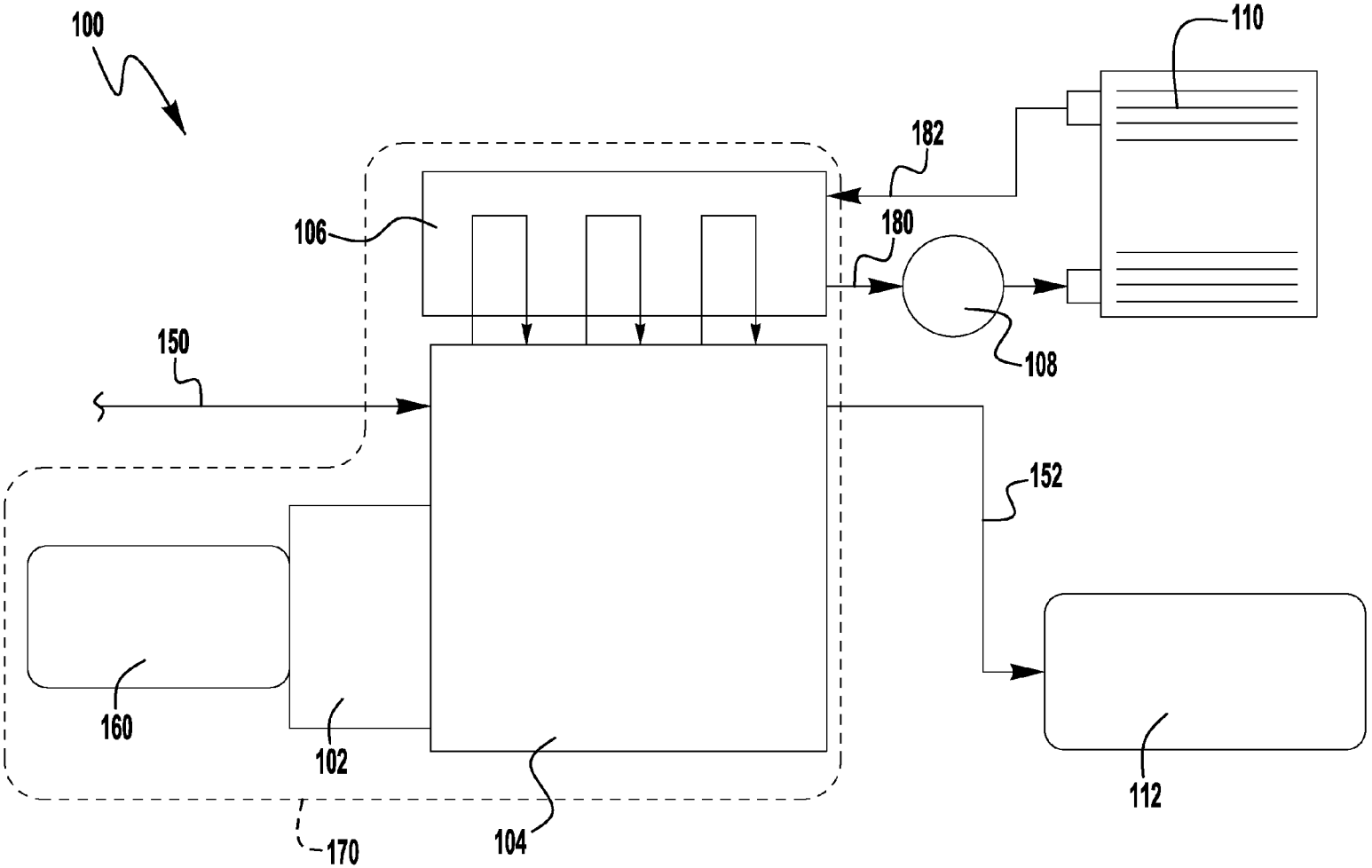
FIG. 1 schematically illustrates a natural gas compression system according to an embodiment of the present application.

The natural gas compression system of the present application is suitable for in-vehicle or home use and requires minimal service. The natural gas compressor of the system has an increased efficiency and service interval relative to conventional natural gas compressors. For example, in certain embodiments, the compressor has an oil free design, runs at a slower speed than conventional compressors, and has a planar water-cooled head. The oil free compression zone of the compressor limits the need for expensive, complicated filters and dryers which require constant service, maintenance, and replacement. Further, the capability of the compressor to operate at slower speeds permits the use of organic seals such as, for example, seals made of polyamide, polyimide, polyfluroethylene (PTFE), poly[terafluoroethylene-co-perfluoro (alkyl vinyl ether)], polyetherketone (PEEK), polyphenylene sulfide (PPS), and/or blends, mixtures, or combinations thereof. These organic seals are often less expensive, easier to produce, and more readily available than other seals.

The efficiency of the natural gas compressor is further enhanced by a water cooling system. By compacting the design and introducing a water jacket, the cooling is brought closer to the source of the heat which increases heat transfer, reduces cylinder temperatures, prolongs the life of the compressor components, and accomplishes densification of the gas. These features also permit the use of a simple mechanical drivetrain having a straight crankshaft connected to eccentrics, which are connected to piston push rods with a driving member or walking beam. The components of the compressor are robust, compact, and permit guide bushings in multiple locations to eliminate side loading of piston seals, further prolonging life and increasing efficiency of the compressor.

In certain embodiments, the natural gas compressor comprises a water-cooled, 3 to 5 cylinder design with separation of oil and gas pathways running at low rpm's. The natural gas compressor is activated by an electric motor which is attached to a torque multiplier. The torque multiplier or gear reducer reduces the rpm's of the motor to that of the crankshaft rpm's desired to operate the compressor. The compressor has a gas flow path which takes the home source of natural gas at a pressure of about ½ to 3 psi and compresses the gas up to at least 3600 psi. The water-cooled compressor has a water pathway that takes the circulating water through the compressor with intimate contact on each cylinder wall to a common water-cooling bath containing inter-stage plumbing, also called an intercooler. The water circulation is driven by a water pump and may use the radiator coolant located onboard the vehicle. The output of the compressor delivers the natural gas to the compressed natural gas (CNG) tank located onboard the vehicle. In certain embodiments, the natural gas compressor comprises a water-cooled, 5 cylinder design arranged with a common linear head.

FIG. 1 schematically illustrates a natural gas compression system 100 according to an embodiment of the present application. As shown, the system 100 includes a compressor assembly 170 comprising a motor 160, a torque multiplier or gear reducer 102, a natural gas compressor 104, and an intercooler 106. The system 100 further comprises a water pump 108, a radiator 110, and a compressed natural gas (CNG) storage tank 112. The motor 160 drives the compressor 104 which compresses the natural gas 150 and delivers the compressed natural gas 152 to be stored in the CNG storage tank 112. The motor 160 may be a variety of different types of motors such as an electric motor, hydraulic motor, an engine (e.g., an engine of the vehicle), or the like. In certain embodiments, the motor is an AC induction motor having 2-3 HP, running between 1700 and 3600 RPM, and operating on 110V or 220V; however, the motor may also be a DC motor as well.

The natural gas compression system 100 comprises a water circulation system for cooling the natural gas and compressor components as the gas is compressed by the compressor 104. It should be understood that other coolants may be used in lieu of or in addition to the water of the circulation system. Thus, the water cooling systems and components described herein may be configured for use with other liquid coolants. For example, the water cooling system of the present application may comprise water and ethylene glycol. As illustrated in FIG. 1, the circulation system comprises the intercooler 106, the pump 108, and the radiator 110. The circulation system may be configured to cool the natural gas as it is compressed within a cylinder of the compressor 104 and/or as the compressed natural gas is transferred from one stage to the next in the compressor.

For example, as illustrated in FIG. 1, the compressed natural gas exits the compressor 104 and passes through the intercooler 106 between the various stages of compression to cool the gas. In certain embodiments, the natural gas travels through the intercooler 106 in conduits (e.g., stainless steel tubing) which facilitates the transfer of heat from the compressed gas to the intercooler water bath. The heated water 180 of the intercooler 106 exits the intercooler and is circulated by the pump 108 through the radiator 110 for cooling. The cooled water 182 exits the radiator 110 and returns to the intercooler 106. In certain embodiments, the radiator 110 may be a water-air radiator onboard the vehicle. The onboard radiator may be the original radiator of the vehicle for engine cooling or another radiator in addition to the original radiator. Further, the pump 108 may be the water pump onboard the vehicle, whether the original pump or another pump in addition to the original pump.

The compressor 104 the system 100 may be a variety of compressors capable of compressing natural gas to between about 3000 and 5000 psi. The compressor 104 generally has multiple piston cylinder assemblies fluidly connected in sequence to form multiple compression stages, e.g., 2, 3, 4, 5 or more stages of compression.

In certain embodiments, the compressor 104 comprises a housing, a plurality of cylinder piston assemblies disposed within the housing, a water jacket having at least one conduit that cools the cylinder piston assemblies, at least one cylinder head secured to the housing and comprising a plurality of cylinder head conduits that fluidly connect the cylinder piston assemblies, an intercooler that cools the natural gas between the compression stages of the compressor, and a drive system for moving the pistons of the cylinder piston assemblies to compress natural gas within the cylinders of the assemblies. Each cylinder piston assembly comprises a non-lubricated piston for compressing natural gas within a cylinder of the assembly. Thus, each cylinder piston assembly comprises a piston, cylinder, and seal and is non-lubricated in that no additional lubricants are used during compression of the gas within the cylinder. The plurality of cylinder piston assemblies are fluidly connected in sequence such that each assembly forms a compression stage of the compressor. In one embodiment, the pressure of compressed natural gas exiting the last cylinder piston assembly of the compressor is between about 2000 and 5000 psi when a drive shaft of the drive system is rotating between about 50 and 500 RPM.

In certain embodiments, the drive system of the compressor 104 comprises, for each cylinder piston assembly, an eccentric connected to the drive shaft and a connecting rod, a driving member connected to the connecting rod, a piston push rod connected to the driving member and engaging the piston of the assembly. The rotation of the drive shaft rotates the eccentric and oscillates the connecting rod. Oscillation of the connecting rod oscillates the driving member and oscillation of the driving member moves the piston to compress natural gas within the cylinder of the assembly. The pistons of the cylinder piston assemblies and the piston push rods of the drive system may comprise organic seals. Further, each driving member of the drive system may be connected on opposite sides of the corresponding piston push rod. Further, each piston push rod of the drive system may be supported by upper and lower bushings, the upper bushing located above the connection of the driving member and the lower bushing located below the connection of the driving member.

The compressor 104 generally has a compact mechanical design so that it fits onboard a vehicle. One of the features that contributes to the compressor 104 having a compact design is the design and arrangement of the mechanical components that convert the rotational energy of the motor to linear motion to motivate the pistons. The linear motivation of the pistons is made possible by use of a driving member. The driving member acts like a walking beam such that the force is turned 180 degrees. Further, the compressor 104 may include a physical separation of oil and gas within the compressor.

The compressor 104 may also comprise organic seals on the pistons reciprocating inside the cylinders of the piston cylinder assemblies, as well as the piston push rods. The life of the organic seals may be increased by a water cooling system that circulates cooling water pass the sidewalls of the cylinders in which the heat or compression is generated, by limiting the amount of sideways motion on the organic seals, and by the pistons having a slow reciprocating speed such as, for example, between 50 and 500 RPM or, in at least one embodiment, 200 RPM. The lack of sideways motion for the organic seals may be accomplished, at least in part, by holding the piston on both ends with lower and upper guide bearings. The piston push rod may also not be lubricated with oil but is sealed with a dry organic seal, thus oil is prohibited from mixing with the compressed natural gas.

As discussed above, the natural gas compression systems and compressor assemblies of the present application may be configured for use in a vehicle. For example, the compression systems and compressor assemblies may be used in trucks, pickup trucks, vans, sedans, forklifts, tow motors, or any vehicle having an engine capable of operating using compressed natural gas. For example, the compression systems and compressor assemblies may be located in the bed of a pickup truck, in the rear or under the seats in a van or truck, or in the trunk of a sedan. The compression systems and compressor assemblies may be, for example, OEM conversions or aftermarket conversions.

All components of the natural gas compression system 100 may be located in the vehicle. For example, the compressor assembly 170 may be sized and configured such that it fits in a small or medium sized vehicle, e.g., in the trunk of a small car such as a Ford Focus. In certain embodiments, the compressor assembly 170 is sized such that it occupies no more than between about 2000 and 12,000 $in^3$, between about 4000 and 10000 $in^3$, between about 5000 and 8000 $in^3$, about 7000 $in^3$, and about 8000 $in^3$. In one embodiment, the compressor assembly 170 is compact and has dimensions not greater than 14 in×14 in×36 in (35.6 cm×35.6 cm×91.4 cm) so that it may fit in a small to medium sized vehicle. However, It should be understood that one or more portions of the natural gas compression system 100 may be disposed outside of the vehicle, e.g., in the garage or carport. For example, the compressor assembly 170 and water circulation system may be disposed outside of the vehicle.

Figure 2A:
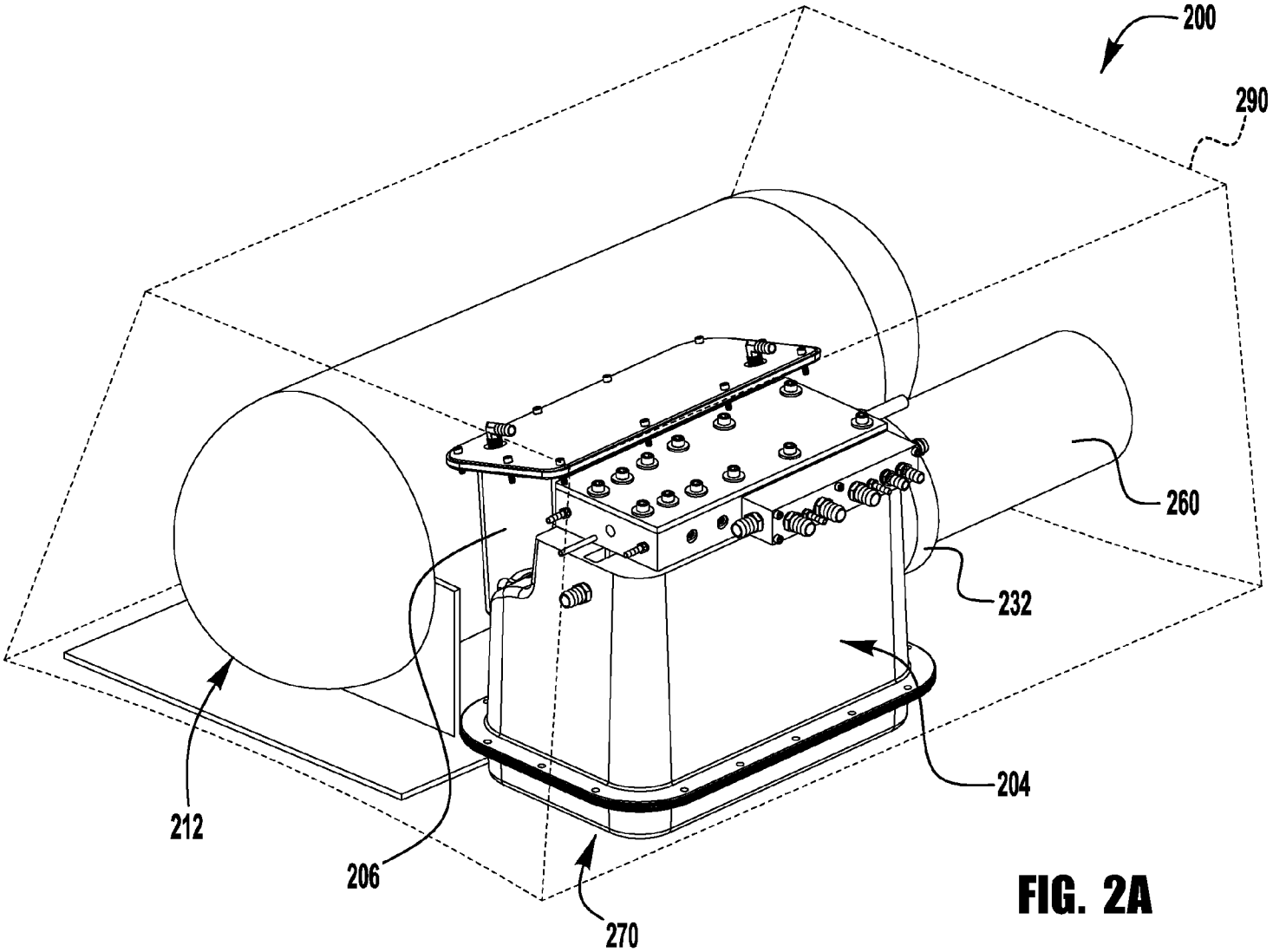
FIG. 2A is a perspective view of a natural gas compression system according to an embodiment of the present application.

FIG. 2A illustrates a natural gas compression system 200 according to an embodiment of the present application. As shown, the system 200 comprises a CNG storage tank 212 and a compressor assembly 270 having an electric motor 260, a torque multiplier or gear reducer 202, a natural gas compressor 204, and an intercooler 206. The electric motor 260 drives the compressor 204 which compresses the natural gas and delivers the compressed natural gas to be stored in the CNG storage tank 212. Although not shown in FIG. 2A, the intercooler 206 is part of a water circulation system that further comprises a pump and a radiator to circulate and cool the water. In certain embodiments, the pump and/or radiator of the vehicle may be used.

FIG. 2A illustrates an exemplary arrangement of the compressor assembly 207 and the CNG tank 212 of the natural gas compression system 200. As shown, the system 200 is arranged such that it is capable of fitting in a vehicle, e.g., in the trunk of an automobile. For example, the volume 290 represents the dimensions and volume of an exemplary trunk in a small vehicle, such as a Ford Focus. In certain embodiments, the volume 290 is sized such that it occupies no more than between about 25,000 and 50,000 $in^3$, between about 30,000 and 40,000 $in^3$, between about 33,000 and 37,000 $in^3$, and about 35,000 $in^3$. In one embodiment, the volume 290 has a length, width, and height not exceeding 48 in×35 in×20.5 in (122 cm×95 cm×52 cm). As illustrated in FIG. 2A, the natural gas compression system 200 is sized and arranged to fit within the volume 290. The compressor assembly 207 is compact and has a small footprint so that it takes up a small volume of space, such as in the trunk of a vehicle or as a wall-mounted appliance. In certain embodiments, the compressor assembly 207 is sized such that it occupies no more than between about 2000 and 12,000 $in^3$, between about 4000 and 10000 $in^3$, between about 5000 and 8000 $in^3$, about 7000 $in^3$, and about 8000 $in^3$. In one embodiment, the compressor assembly 207 has dimensions not greater than 14 in×14 in×36 in (35.6 cm×35.6 cm×91.4 cm).

Figure 2B:
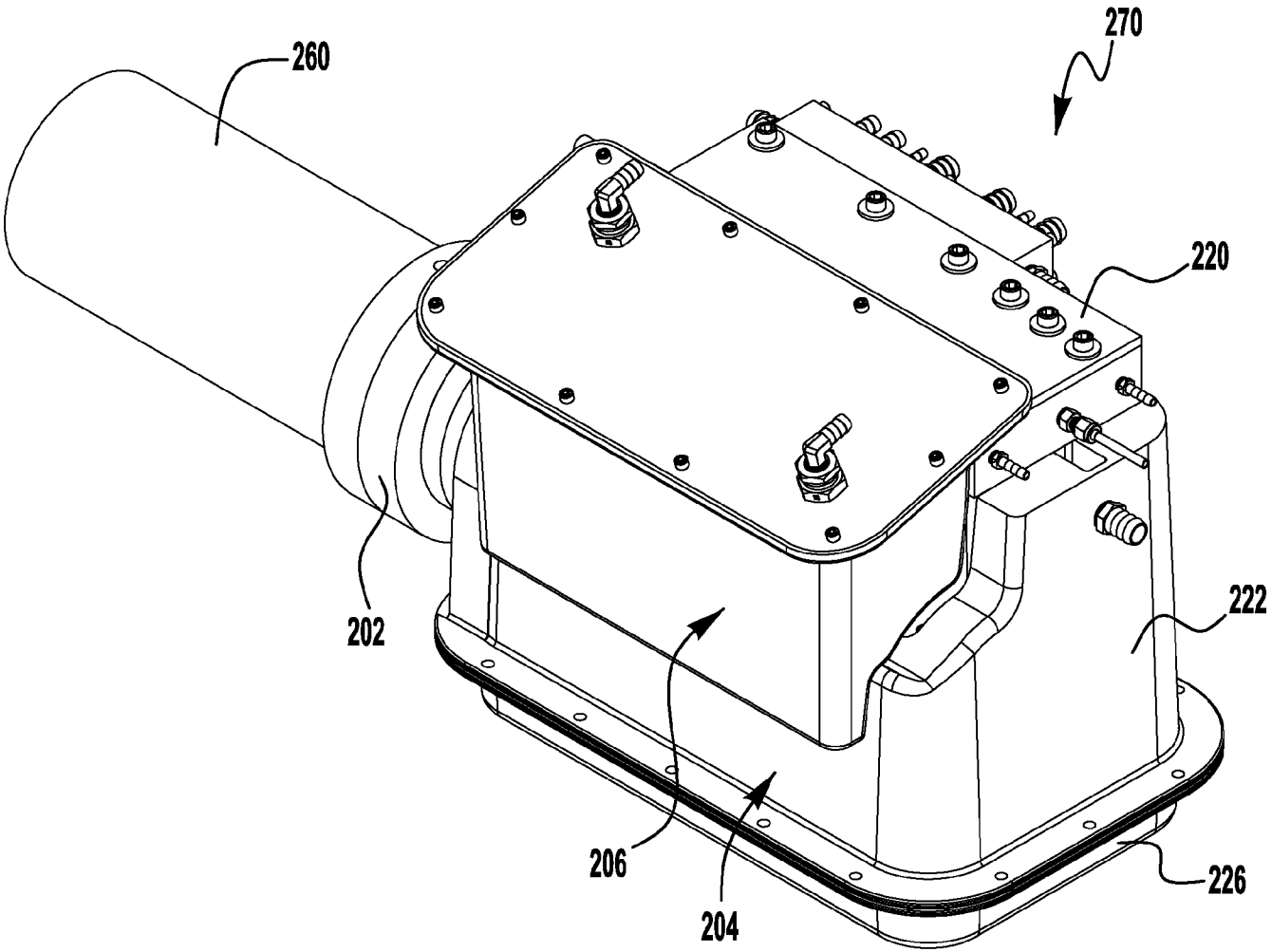
FIG. 2B is a perspective view of a natural gas compressor assembly of the compression system shown in FIG. 2A.
Figure 2C:
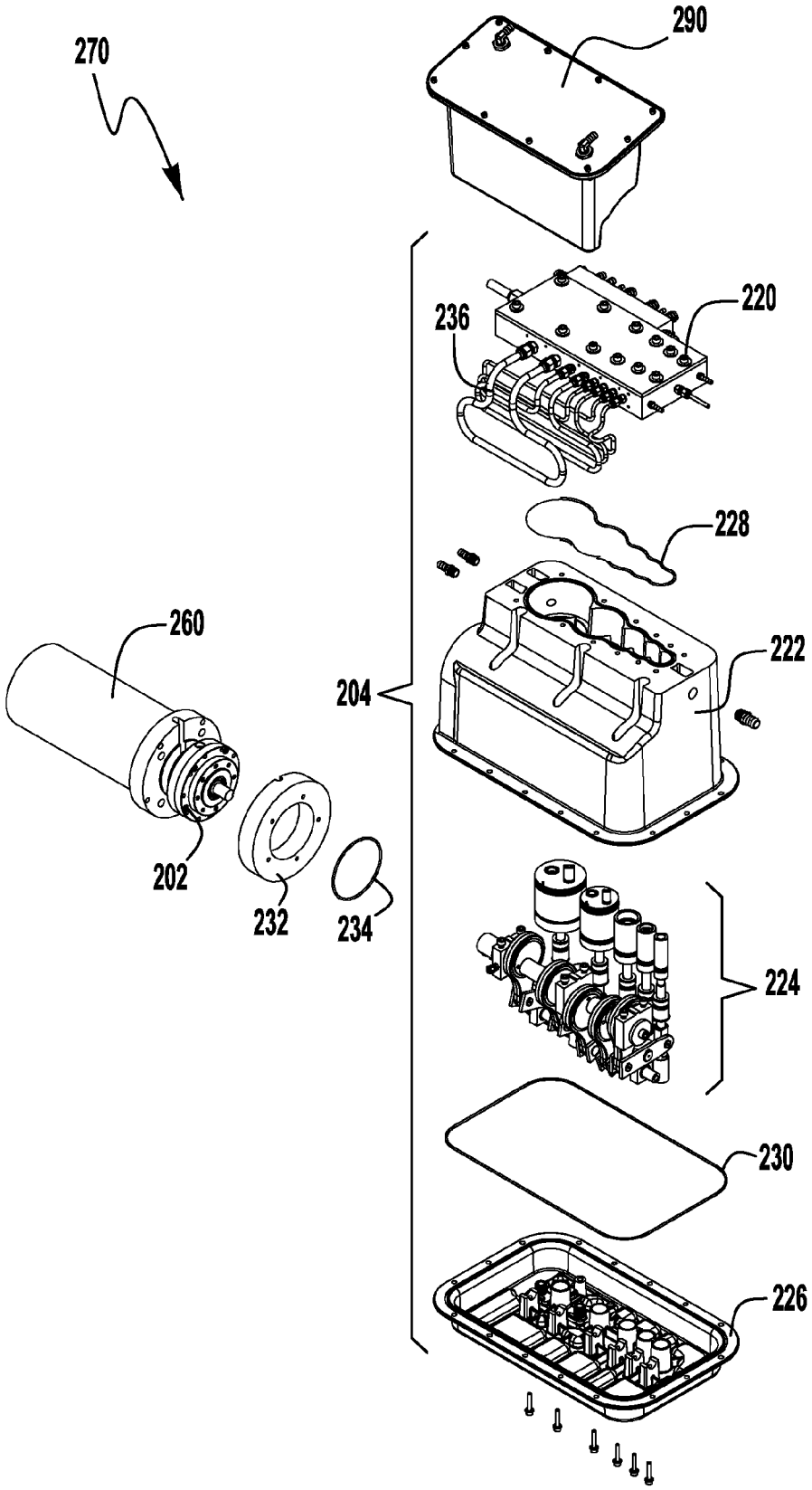
FIG. 2C is an exploded perspective view of the of the natural gas compressor assembly shown in FIG. 2B.

FIGS. 2B and 2C illustrate the compressor assembly 270 of the natural gas compression system 200. The compressor 204 is a residential automotive natural gas compressor. In certain embodiments, the compressor 204 is capable of compressing natural gas to a pressure between about 2000 and 5000 psi and has a capacity of between about ½ and 3 GGE (Gasoline Gallon Equivalent) of CNG per hour (between about 63 and 380 standard cubic feet of natural gas @ 200° F.). In one embodiment, the capacity of the compressor 204 is between about ½ and 1½ GGE of CNG per hour. As described above, the compressor 204 may be installed in the vehicle or where a vehicle may be stored or refueled, e.g., on or near a structure such as a garage, carport, etc.

As illustrated in FIG. 2C, a piston drive assembly 224 of the compressor 204 is contained within a housing. The housing comprises a lower casing 226 and an upper casing 222 that are sealed with a gasket or other seal 230. The compressor 204 further comprises a cylinder head or cylinder cap top plate 220 that is securely attached to an upper casing 222. As discussed below, the cylinder head 220 forms at least a portion of the compression cylinders and comprises conduits for the flow of natural gas between cylinders. The term "conduit" as used herein may be any passage, tube, channel, pipe, feature, element (e.g., a brazed element or plate), or the like capable of carrying a fluid, whether liquid or gas, from one point to another. The cylinder head 220 is sealed with the upper casing 222 using a gasket 228 (e.g., organic rubber), however other suitable seals may be used.

In certain embodiments, the housing is a two piece die-cast aluminum housing. The two piece die-cast aluminum housing offers an inexpensive, lightweight means of encasing the parts of the compressor 204. The housing of the compressor may also be configured such that its exterior forms other portions of the compressor assembly or compression system such as, for example, the torque multiplier or water pump housing, thereby providing a modular low cost construction.

As illustrated in FIG. 2C, the intercooler 206 (FIG. 2B) of the compressor assembly 270 includes a tank housing 290 and conduits 236 attached to the cylinder head 220. As described in more detail below, natural gas exits the compression cylinders of the compressor 204 between the various stages of compression through the conduits 236 and passes through the water bath in the tank housing 290 to cool the gas. The intercooler housing 290 encloses the conduits 236 which, as shown, is a series of tubes bent in such a manner as to be compactly coiled within the housing. In certain embodiments, the natural gas travels through the tank housing 290 in stainless steel tubing which facilitates the transfer of heat from the compressed gas to the intercooler water bath. Thus, the intercooler 206 is a circulating bath which takes water to the area of the compressor 204 where heat is generated due to the friction of organic seals against the cylinder walls.

As illustrated in FIG. 2C, the electric drive motor 260 and the torque multiplier 202 are connected to the piston drive assembly 224 and mounted to the upper casing 222 with a motor mount 232 and a gasket or other seal 234. The torque multiplier 202 is used at the interface of the electric motor 260 and compressor crankshaft. The torque multiplier 202 couples the compressor crankshaft with the drive motor 260 and serves at least two primary purposes. First, the torque multiplier 202 reduces the motor output speed to a suitable speed for the compressor 204. For example, the torque multiplier 202 may be configured to reduce the output speed of the motor 260 such that the input speed to the compressor 204 is between about 50 RPM and about 500 RPM. In one embodiment, the torque multiplier 202 is a planetary gearbox and has an 18:1 reduction in output speed which permits the use of a 3600 rpm motor while providing a desired input speed of about 200 rpm to the compressor 204. Second, through this reduction in speed, an equivalent multiplication of torque is provided by the torque multiplier 202. The increase in torque permits the compressor 204 to overcome the large piston forces generated due to the low shaft speed. As such, the torque multiplier 202 allows the use of low torque/high speed motors which are typically compact and inexpensive. Exemplary embodiments of the torque multiplier 202 include a worm drive with worm and helical gear, in-line cycloidal, planetary gearboxes, and belt and pulley systems.

FIGS. 3-6 illustrate the compressor 204 with the cylinder head 220 removed. The compressor 204 has a piston drive assembly 224 (FIG. 2C) inside the housing of the compressor. As shown, the piston drive assembly 224 comprises five linearly arranged cylinder/piston assemblies. The largest cylinder/piston assembly is labeled 300 in FIG. 3. The cylinder/piston assemblies are sized in order from largest to smallest following the sequence of 300, 302, 304, 306, and 308. Each compression cylinder/piston assembly is considered a stage of compression. As such, the compressor 204 comprises five stages of compression ranging from a first stage of compression produced by cylinder/piston assembly 300 to a fifth stage of compression produced by cylinder/piston assembly 308. However, in certain embodiments, the compressor may have more or less cylinder/piston assemblies and stages of compression, e.g., 1, 2, 3, 4, 6, or more. Each cylinder/piston assembly 300, 302, 304, 306, and 308 comprises a piston, cylinder, and at least one seal and is non-lubricated in that no additional lubricants are used during compression of the gas within the cylinder.

In certain embodiments, the diameters of the cylinder/piston assemblies 300, 302, 304, 306, and 308 range between about 5 and ¼ inches and the volumes range between about 12 and ¼ $in^2$. In one embodiment, the cylinder/piston assemblies 300, 302, 304, 306, and 308 have the following diameters and volumes:

| | Stage 1 | Stage 2 | Stage 3 | Stage 4 | Stage 5 |
|---|---|---|---|---|---|
| Diameter (in) | 3.4 | 2.4 | 1.5 | 1.0 | 0.6 |
| Volume ($in^2$) | 11.1 | 5.6 | 2.3 | 0.9 | 0.3 |

Figure 3:
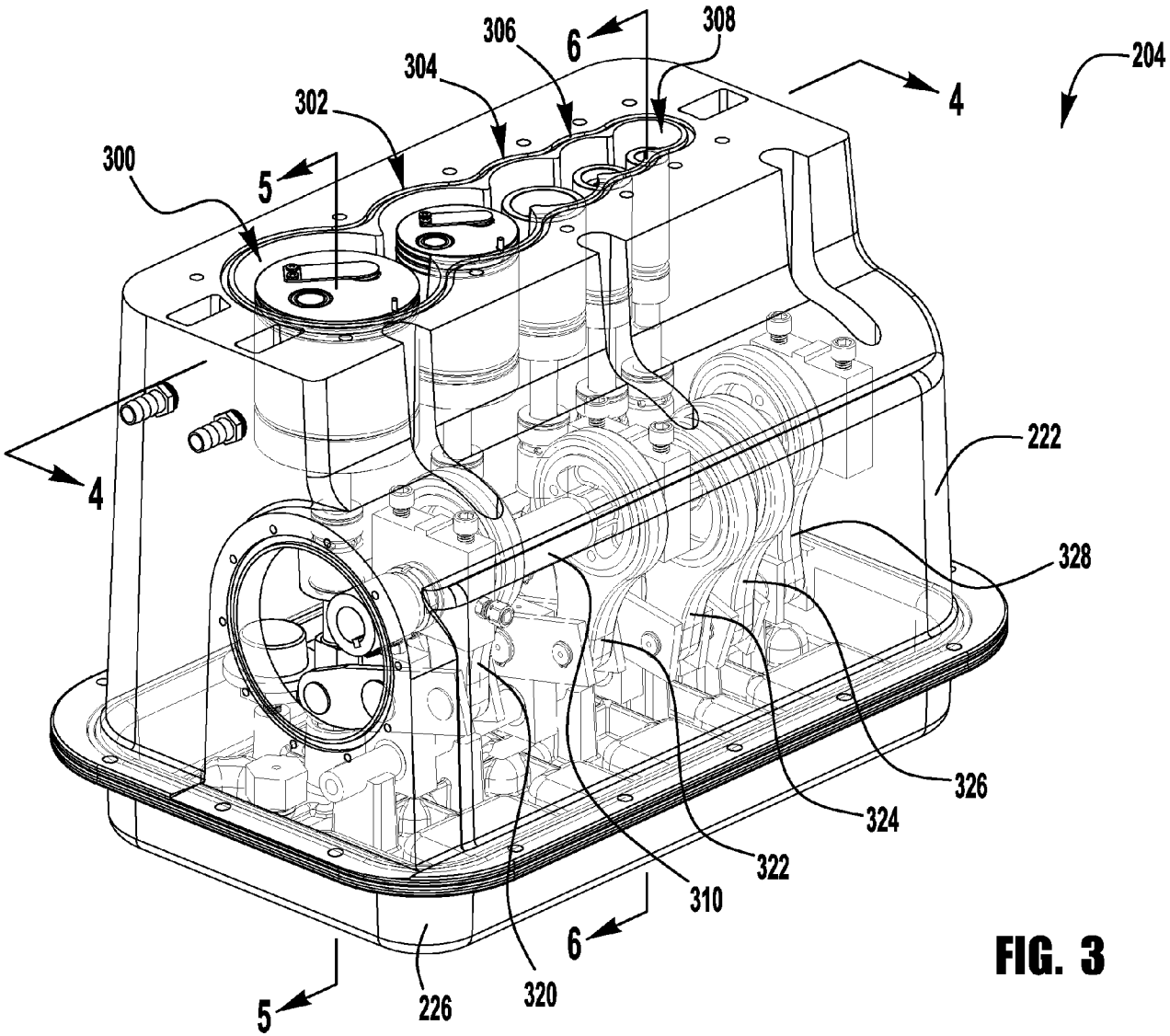
FIG. 3 is a perspective view of a natural gas compressor of the natural gas compressor assembly shown in FIG. 2B.

FIG. 3 illustrates five connecting rods of the piston drive assembly 224 connected to the crankshaft 310, one for each cylinder/piston assembly. The connecting rods for cylinder/piston assemblies 300, 302, 304, 306, and 308 are shown and labeled 320, 322, 324, 326, and 328, respectively. Further, the pan of the lower compressor housing 226 is filled with oil for lubrication of the piston drive assembly 224. The approximate oil level fill line 452 is shown in FIGS. 4 and 5.

Figure 4:
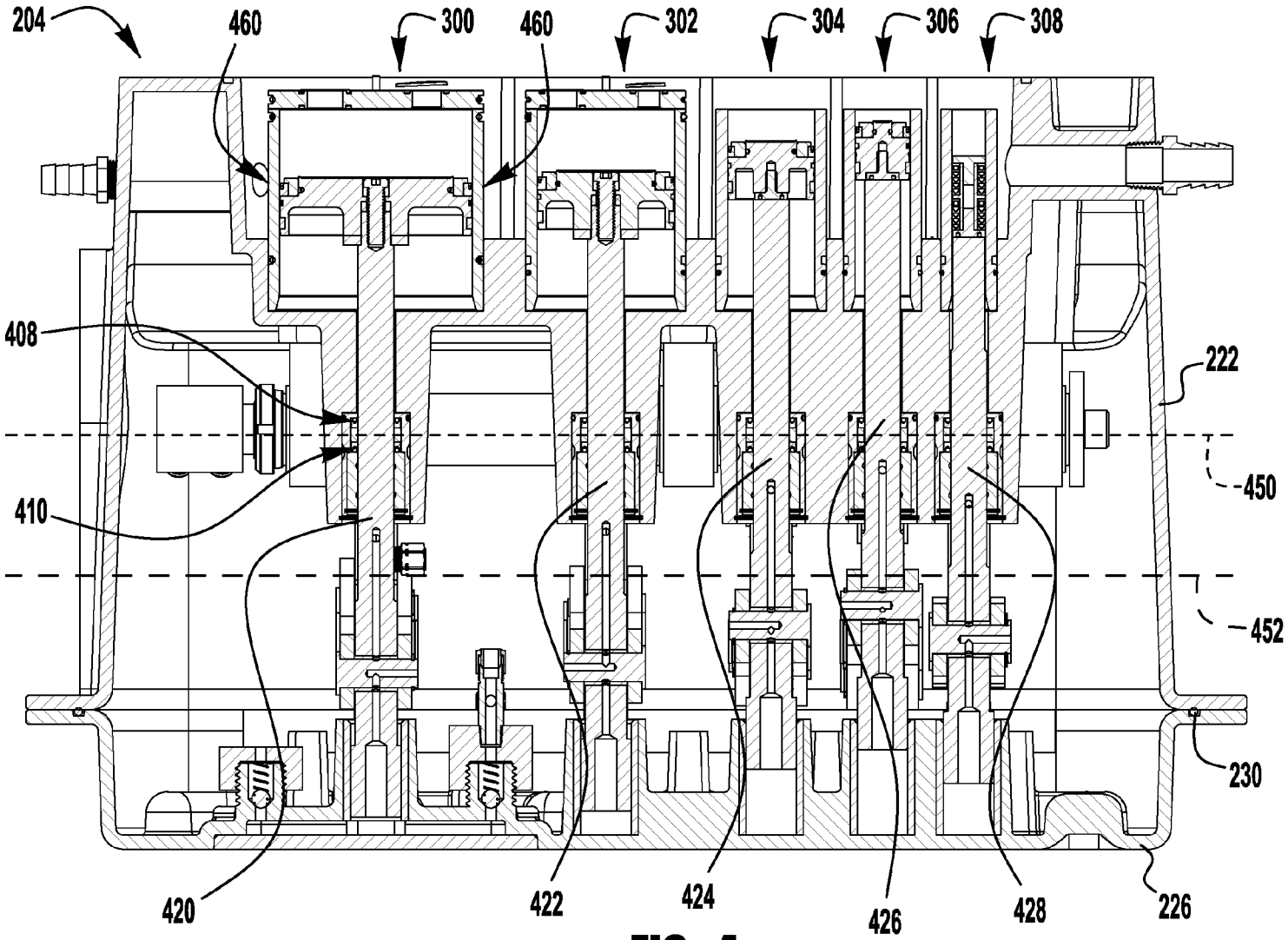
FIG. 4 is a cross sectional view of the natural gas compressor shown in FIG. 3 taken along line 4-4.
Figure 5:
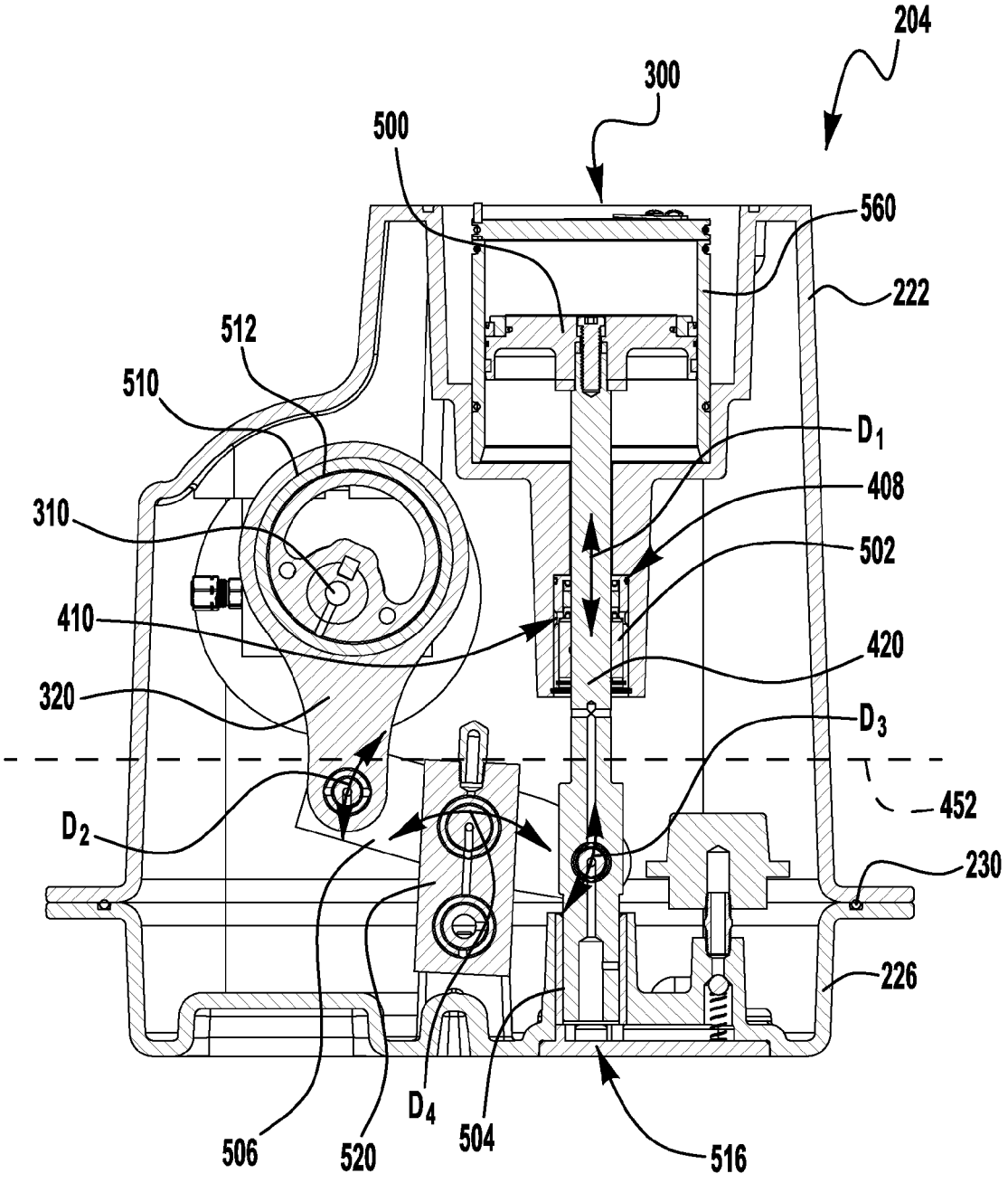
FIG. 5 is a cross sectional view of the natural gas compressor shown in FIG. 3 taken along line 5-5.

FIG. 4 is a cross-sectional side view of the natural gas compressor 204 taken along line 4-4 of FIG. 3. Here, the five linearly arranged cylinder/piston assemblies are illustrated and they have a common linear planar top surface. As shown, the pistons of the five cylinder/piston assemblies 300, 302, 304, 306, and 308 are at various points of compression within the compression cylinders. This is because the pistons are timed to balance the load on the motor and for gas delivery to the subsequent downstream stages. FIG. 4 also illustrates five piston push rods, each connected to a piston of a cylinder/piston assembly. The piston push rods for cylinder/piston assemblies 300, 302, 304, 306, and 308 are shown and labeled 420, 422, 424, 426, and 428, respectively.

FIG. 4 further illustrates features which separate the areas in which oil and gas are located within the compressor 204. The line 450 in FIG. 4 represents the separation of oil and gas within the compressor housing. The natural gas undergoing compression is separated from flowing into oil-filled areas of the compressor 204 with the use of dry organic seals. In certain embodiments, the dry organic seal is a PEEK, PTFE or inorganic filled PTFE seal. The dry organic seals may be used in a variety of locations within the compressor, such as on the piston push rods and pistons.

For example, the location of a dry organic seal 408 on the piston push rod 420 of the first stage cylinder/piston assembly 300 is illustrated in FIG. 4. Because the organic seal 408 does not need oil to lubricate the piston push rod 420, oil is prohibited from mixing with the natural gas, potentially causing the hazard of contaminated gas fouling the vehicle's fuel system. The other four stages of the compressor 204 also comprise at least one dry organic seal on the piston push rod in the same or similar location as seal 408. Further, located below the dry organic seal 408 on the piston push rod 420 is an oil wiper 410. The oil wiper 410 removes oil from the piston push rod 420 as it moves. The other four stages of the compressor 204 also comprise at least one oil wiper on the piston push rod in the same or similar location as oil wiper 410.

The cylinder/piston assemblies 300, 302, 304, 306, and 308 are also non-lubricated and use dry organic seals. For example, as illustrated in FIG. 4, the seal 460 on the piston of the first stage cylinder/piston assembly 300 is a dry organic seal. The other four stages of the compressor 204 also comprise at least one dry organic seal on the piston in the same or similar location as seal 460.

To increase the efficiency and life cycle of the compressor 204, the linear speeds of the pistons are generally reduced to well within acceptable pressure-velocity (PV) ranges for dry organic seals. For example, in certain embodiments, the driveshaft 310 has a slow rotational speed of about 200 rpm and the piston push rod 420 has a stroke of about 1¼ inches producing a linear speed of the pistons below 42 ft/min. This yields a maximum PV value of under 150,000 psi*ft/min for the highest pressure seal in the fifth stage cylinder/piston assembly 308. In one embodiment, the PV values for stages 1-5 in psi*ft/min are about 1800, 5600, 17000, 50000, and 150000 respectively. With these reduced PV values, the compressor 204 is able to deliver consistent performance over a life cycle of 3000-5000 hours with little or no maintenance. This is in direct comparison to conventional compressor units which operate on a very short stroke and very high speed, often 1800 rpm or greater, which produces unnecessarily high wear on seals, poor thermal efficiency, and leads to short life spans and decreased performance. The decreased speed allows the compressor 204 to operate without any cylinder lubricants or other additives. This eliminates the potential hazard of contaminated gas fouling the vehicle's fuel system.

FIG. 5 is a cross-sectional front view of the compressor 204 shown in FIG. 3 taken along line 5-5 and illustrates the features of the piston drive assembly 224 for the first stage of the compressor, although the description of the drive system applies to the other four stages of the compressor as well. As shown, the piston 500 of the cylinder/piston assembly 300 is actuated by the piston push rod 420 to the move the piston in a direction $D_1$ within the cylinder 560 to compress the natural gas. The piston push rod 420 is supported by two guide bushings, an upper guide bushing 502 separated from a lower guide bushing 504.

As illustrated in FIG. 5, The piston push rod 420 is articulated up and down in the direction $D_1$ by a driving member 506. A first end of the driving member 506 is connected to the connecting rod 320 and a second end of the driving member is connected to the piston push rod 420. As shown in FIG. 3, the driving member 506 is generally connected on opposite sides of the piston push rod 420 to minimize side load on the push rod. The driving member is also connected to the lower housing 226 by a pivoting member 520. Oscillation of the connecting rod 320 moves the first end of the driving member 506 in a direction $D_2$. The pivoting member 520 permits the driving member 506 to act as a walking beam such that movement of the first end in the direction $D_2$ moves the second end of the driving member a corresponding amount in a direction $D_3$, which moves the piston push rod 420 up and down in the direction $D_1$. The use of the driving member or walking beam 506 permits the compressor 204 to convert rotational forces to linear forces with a compact geometry favorable for installation, such as in a vehicle or mounted to a structure.

As illustrated in FIG. 5, the pivoting member 520 will also pivot or oscillate back and forth in a direction $D_4$ as the connecting rod 320 oscillates to facilitate movement of the driving member 506. As shown, the pivoting member is connected at or near the center of the driving member. Further, the connecting rod 320 is connected to the crankshaft or drive shaft 310 of the compressor 204 by an eccentric 512 and an eccentric bearing 510. As the eccentric 512 rotates with the drive shaft 310, the connecting rod 320 oscillates back and forth to move the first end of the driving member 506 in the direction $D_2$. The fill level for the oil used as lubrication of the piston drive assembly 224 is illustrated as line 452 in FIG. 5.

The conversion of rotational energy from the motor 260 to linear motion to motivate the pistons is handled with the eccentric bearing, driving member, and guide bushings for each cylinder/piston assembly 300, 302, 304, 306, and 308. For example, in certain embodiments, the eccentric 512 provides an offset equal to one half stroke which is translated to one end of the driving member 506 via the connecting rod 320. The driving member 506 then serves two purposes. First, the driving member 506 acts like a walking beam such that the force is turned 180 degrees allowing for a more compact design. Second, the position of the pivotal connection of the driving member 506 to the piston push rod 420 may be modified to allow for differential or unequal stroke lengths, for all or some of the pistons. The position of the pivotal connections between the driving member 506 and the connecting rod 320 and/or pivoting member 520 may also be modified in certain embodiments to modify the stroke length of the piston. Changing the stroke length allows for a change in cylinder/piston diameter, which changes the piston rod loading and flow pattern of the natural gas, which in turn affects the balance of the load on the motor and cooling of the compressor. The active end of the driving member 506 is generally pivotally coupled to the piston push rod 420 with a pin. The piston push rod 420 provides the motivating force of compression for the compression pistons.

As discussed above, the piston push rod 420 is guided by the upper guide bushing 502 and the lower guide bushing 504. In certain embodiments, the upper and lower guide bushings 502, 504 are greater than 1.5 inches apart. The guide bushings can be a variety of different types of bushings, including lubricated bronze, polymeric or ferrous bushings. As illustrated in FIG. 5, the upper and lower guide bushings 502, 504 are located above and below the connection of the driving member 506 to the piston push rod 420, respectively, to prohibit side loading on the piston, a cause of failure in many compressor designs. Side loading occurs when the transition from rotational motion to linear motion produces a force vector perpendicular to the desired motion. However, this arrangement prohibits side loading of the piston because the guide bushings 502, 504 are on either side of the applied load providing a large lever arm that reduces the wear on either bushing.

The driving member, pivoting member, connecting rod, eccentric, driveshaft, and the lower portion of the piston push rod which extends between the two guide bushings are generally lubricated by a splash and/or a pressure lubrication system. In certain embodiments when a pressurized lubrication system is used, the lower portion of the piston push rod may comprise an oil pump which pressurizes the lubrication system. For example, FIG. 5 illustrates an oil pump 516 that acts as a displacement plunger type pump. As shown, oil enters a chamber via a check valve during the piston up stroke. On the piston down stroke, the piston push rod 420 displaces the oil through passages to lubricate components of the compressor.

Figure 6:
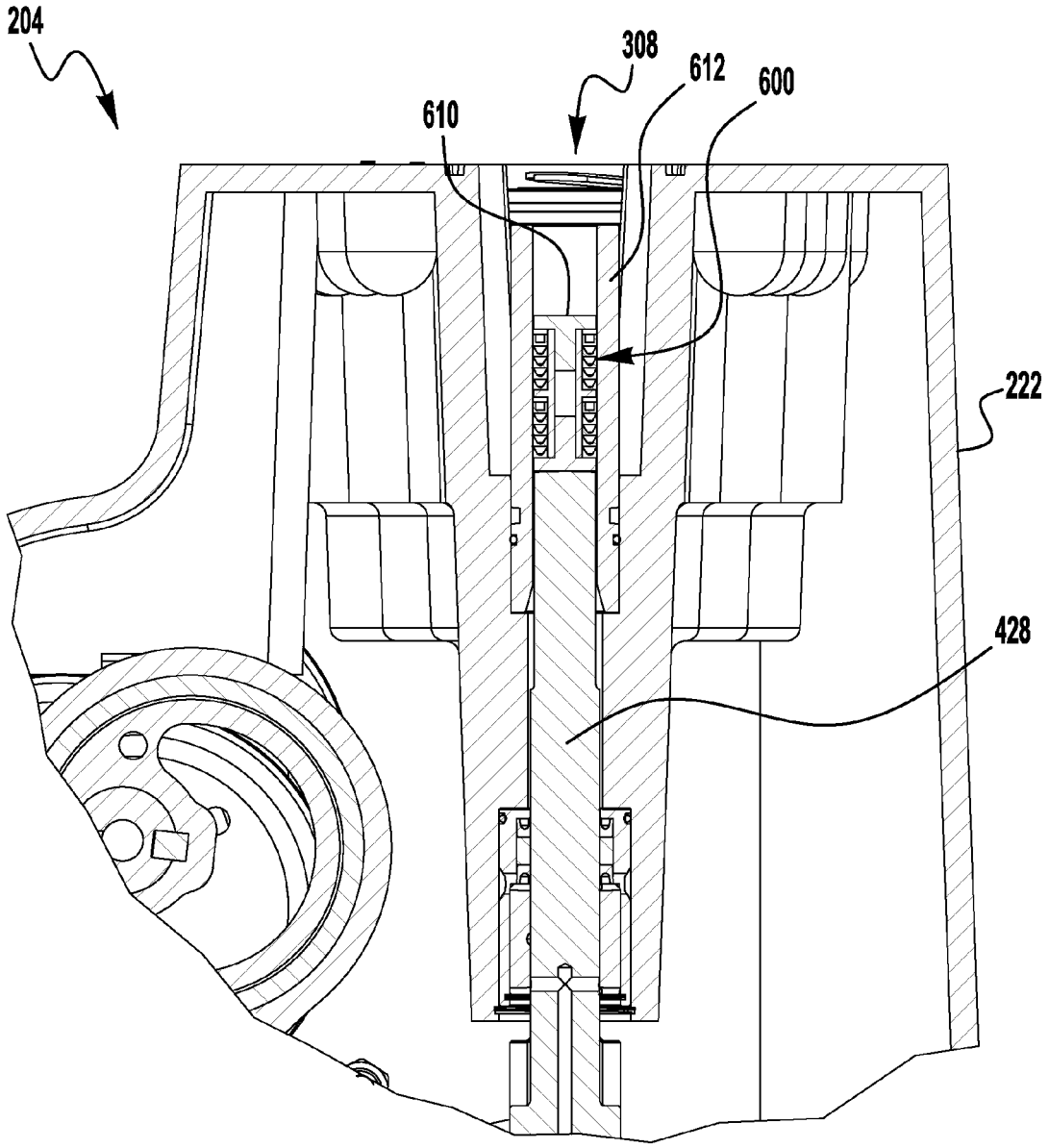
FIG. 6 is a cross sectional view of the natural gas compressor shown in FIG. 3 taken along line 6-6.

Further, in certain embodiments, at least one piston of the compressor may not be connected to the push-rod, but rather the push-rod acts as a pusher only and does not assist in pulling the piston back. For example, as shown in FIGS. 4 and 6, the pistons of cylinder/piston assemblies 304, 306, and 308 are not attached to the piston push rods 424, 426, and 428 respectively. Instead, the push rods 424, 426, and 428 are used to push the piston and compress the gas in the cylinder, then the pressure of the inlet gas returns the piston. Decoupling the push rod and the piston allows for the self-alignment of the piston within the cylinder and prohibits side-load and misalignment from the push rod being transmitted to the piston. As shown in FIGS. 4 and 5, the pistons of cylinder/piston assemblies 300 and 302 are attached to the piston push rods 420 and 422 respectively. More or less of the cylinder/piston assemblies may be connected to the corresponding piston push rod in other embodiments.

FIG. 6 is a cross-sectional front view of the compressor 204 shown in FIG. 3 taken along line 6-6 illustrating the stage 5 or highest pressure piston/cylinder assembly 308. As shown, the seal between the piston 610 and cylinder 612 comprises a plurality of stacked seals 600. As shown, the stacked seals 600 are U-cup shaped seals with alternating layers of sealing material. The sealing material may be organic and/or organic inorganic-filled material. The fillers in the sealing material may be materials with high thermal conductive that facilitate the removal of heat, such as, for example, carbon or graphite. The stacked seals 600 also permit the pressure of the natural gas within the cylinder 612 to spread the seals out evenly and engage tightly around the circumference of interior cylinder wall. Multiple seals provide more contact area to reduce the pressure on any one seal and to distribute the load. Greater surface contact reduces the pressure on any one seal also increases the lifetime of the seals due to less wear.

Figure 7A:
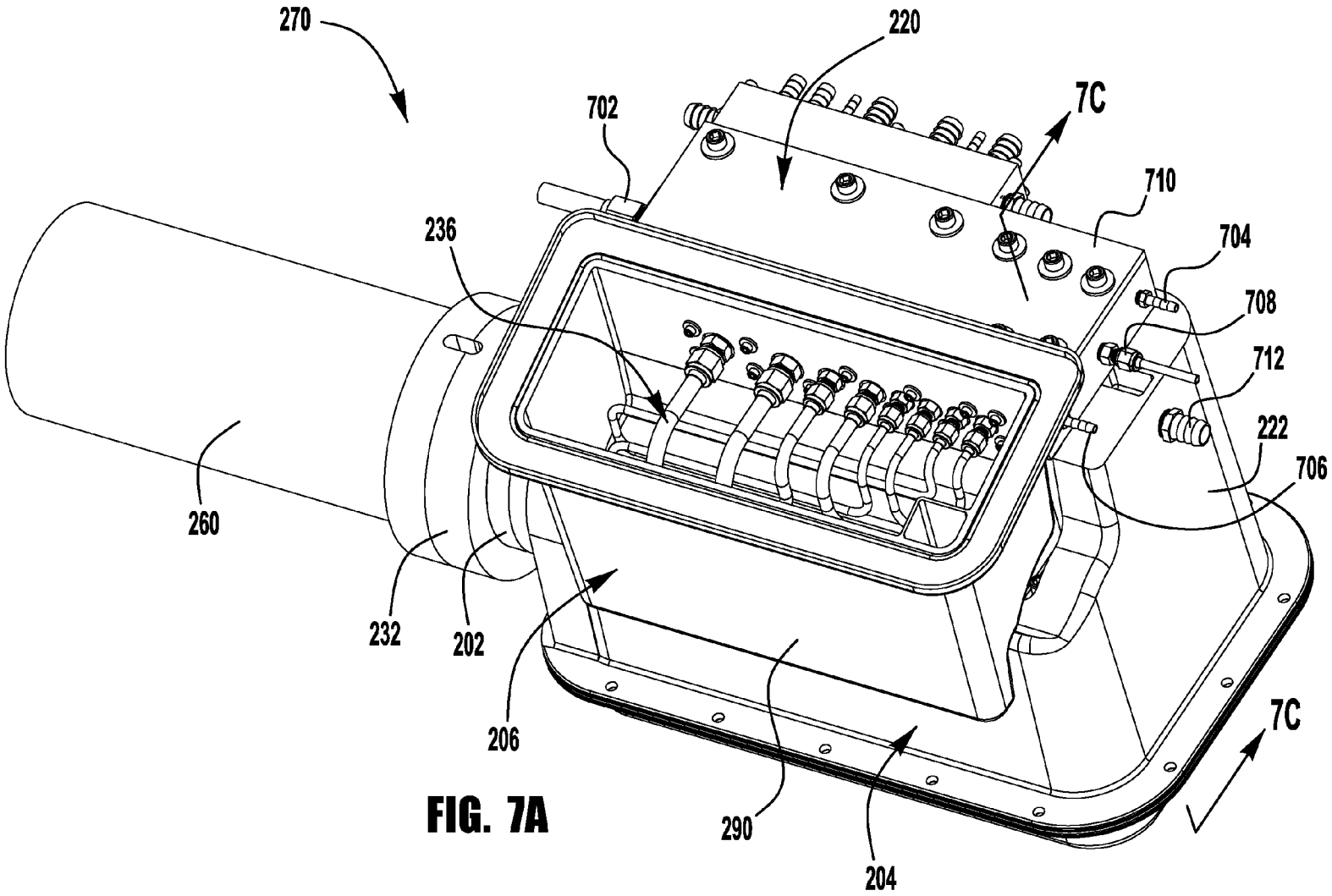
FIG. 7A is a perspective view of a natural gas compressor assembly of FIG. 2B with a top plate of the intercooler tank removed.
Figure 7B:
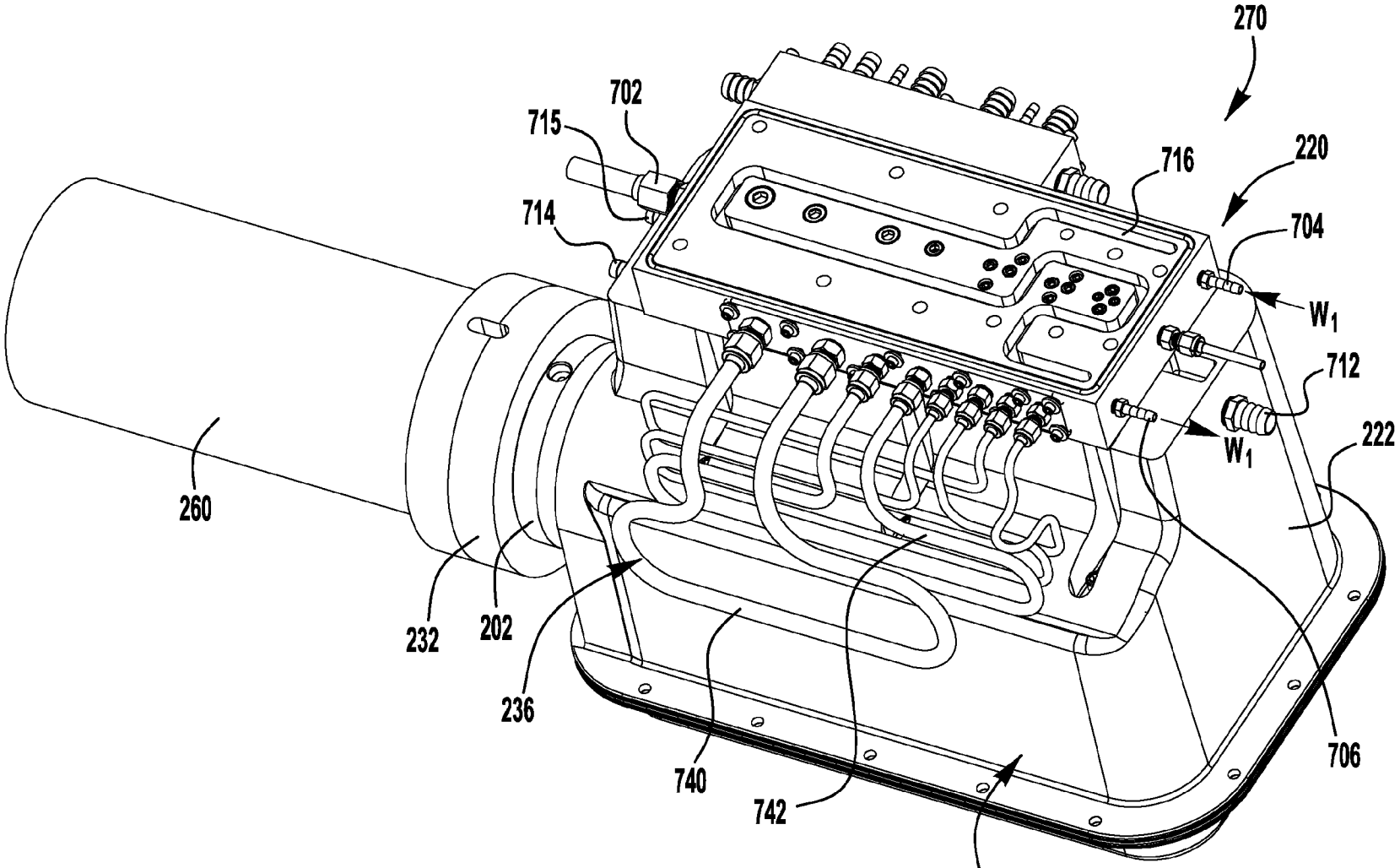
FIG. 7B is a perspective view of a natural gas compressor assembly of FIG. 7A with a top plate of a cylinder head removed and the intercooler tank removed.
Figure 7C:
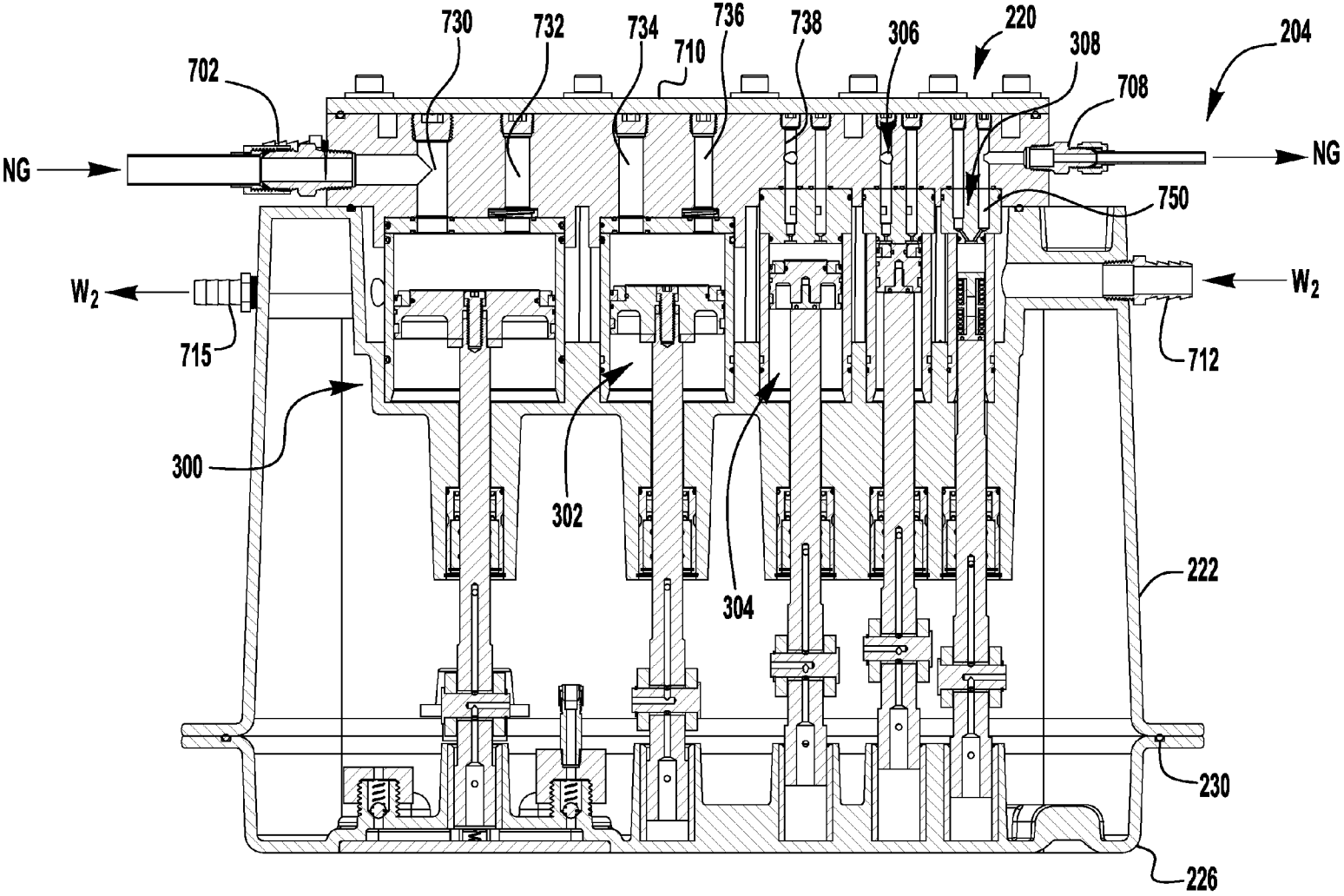
FIG. 7C is a cross sectional view of the natural gas compressor shown in FIG. 7A taken along line 7C-7C.

FIGS. 7A-7C are various views of the compressor 204 of the compressor assembly 270 with the cylinder head 220 secured to the upper housing 222. FIG. 7A is a perspective view of the compressor 204 showing the intercooler tank 290 with the top plate of the tank removed exposing the conduits 236. FIG. 7B is a perspective view of the compressor 204 with the intercooler tank 290 and top plate 710 of the cylinder head 220 removed exposing a cooling channel 716 of the cylinder head. FIG. 7C is a cross sectional side view of the compressor 204 taken along line 7C-7C in FIG. 7A.

FIGS. 7A-7C illustrate the flow of natural gas NG through the various stages of compressor 204. As illustrated in FIG. 7C, the natural gas NG enters the low pressure side of the cylinder head 220 through an inlet 702. The natural gas NG generally comes from a home natural gas supply at a pressure between about ½ and 5 psig, and in certain embodiments between about ½ and 3 psig. The natural gas NG travels through a conduit 730 into the compression chamber of the first stage cylinder/piston assembly 300 where it is compressed by the piston to between about 20 and 40 psig (e.g., about 30 psig). The compressed natural gas NG exits the first stage compression chamber through a conduit 732, into a conduit 740 of the intercooler 206 (FIG. 7B), then through a conduit 734 into the compression chamber of the second stage cylinder/piston assembly 302 where it is compressed by the piston to between about 100 and 140 psig (e.g., about 120 psig). The compressed natural gas exits the second stage compression chamber through a conduit 736, into a conduit 742 of the intercooler 206 (FIG. 7B), then through a conduit 738 into the compression chamber of the third stage cylinder/piston assembly 304 where it is compressed by the piston to between about 350 and 450 psig (e.g., 389 psig or about 400 psig). This process continues for stages 4 and 5—the compressed natural gas enters the compression chamber and is compressed by the reciprocating piston and travels through conduits in the cylinder head and intercooler to the next stage. The respective inlet and outlet gas pressures for stages 4 and 5 are: stage 4 inlet pressure of between about 350 and 450 psig (e.g., 389 psig or about 400 psig) and outlet pressure of between about 1100 and 1300 psig (e.g., 1192 psig or about 1200 psig); stage 5 inlet pressure of between about 1100 and 1300 psig (e.g., 1192 psig or about 1200 psig) and outlet pressure of between about 3200 and 4000 psig (e.g., about 3600 psig). The compressed natural gas NG exits the stage 5 compression chamber, through a conduit 750, and out an outlet 708 of the high pressure side of the cylinder head 220 to the CNG tank onboard the vehicle.

Figure 8:
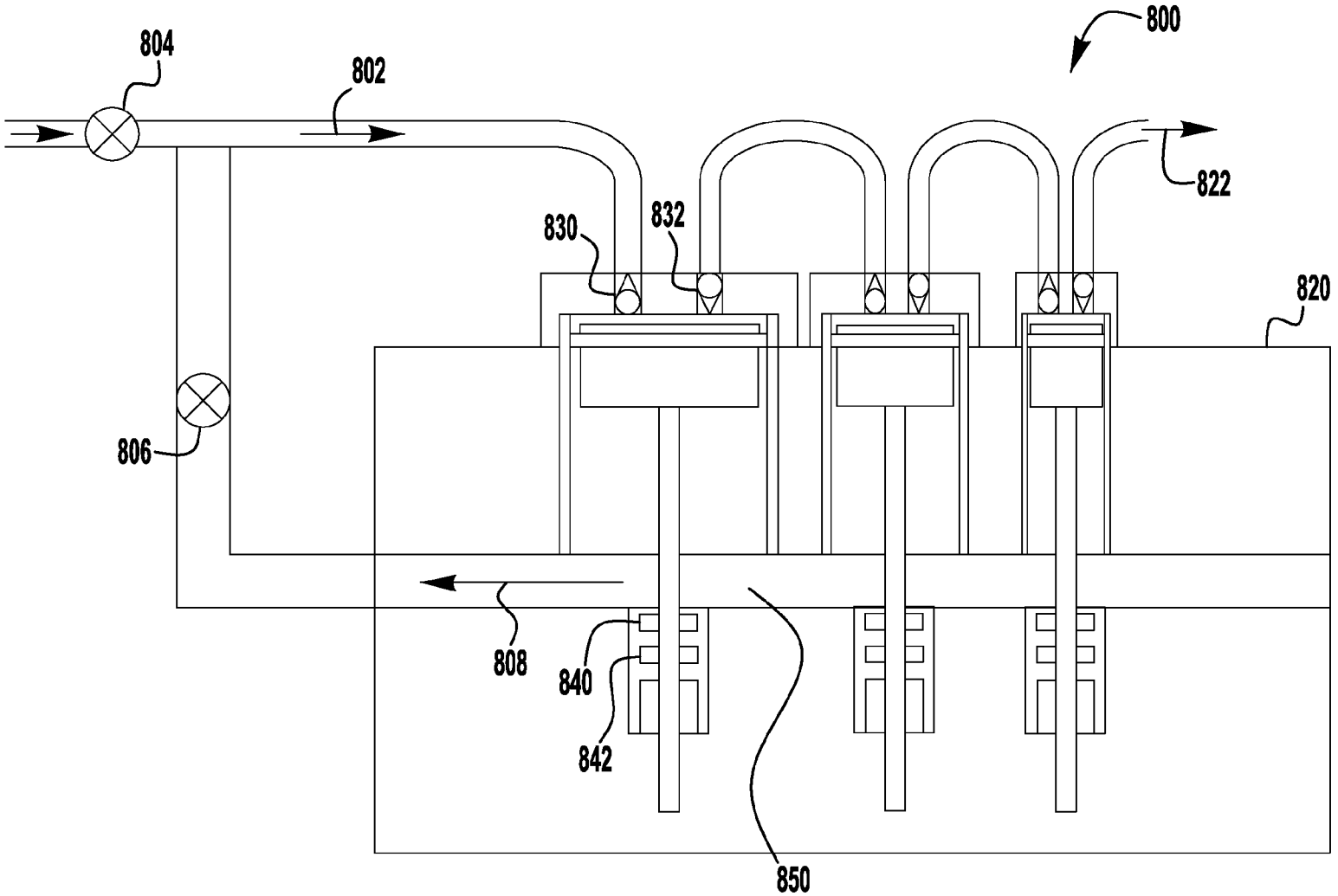
FIG. 8 schematically illustrates a natural gas compressor according to an embodiment of the present application.

In certain embodiments, the compressor of the present application may be configured to recirculate natural gas that has seeped past or "blown by" the seals of the pistons of the compressor. For example, FIG. 8 schematically illustrates a compressor 800 according to an embodiment of the present application. As shown, the compressor 800 has three cylinder/piston assemblies and a lower passageway 850 that receives natural gas 808 that has blown past the pistons and into the compressor housing 820. The lower passageway 850 is positioned above the dry organic seal 840 and oil wiper 842 such that the blow by gas 808 is not contaminated with oil. A valve 806 controls the flow of the blow by natural gas 808 and mixture of the same with incoming natural gas. In operation, natural gas enters the compressor 800 through an inlet valve 804 and combines with the blow by natural gas 808. The combined natural gas 802 then enters the first stage compression chamber through inlet valve 830. Once compressed, the natural gas exits the first stage through an outlet valve 832 and enters the next stage. This sequence proceeds until the last stage where the compressed natural gas 822 exits the compressor to a CNG storage tank.

As illustrated in FIGS. 7A-7C, the compression chambers of the cylinder/piston assemblies and compressed natural gas is cooled by the water in multiple ways. For example, as illustrated in FIGS. 7A and 7B and discussed above, the series of intercooler conduits 236 that extend between each stage of the compressor 204 are submerged in a water bath allowing removal of heat from the compressed gas.

As illustrated in FIG. 7B, the cylinder head 220 may comprise one or more cooling channels or conduits that carry water to cool the compression chambers of the cylinder/piston assemblies and compressed natural gas. As shown, water $W_1$ enters an inlet 704 and extends through the cooling channel or passage 716 in the cylinder head 220 to cool the compression chambers of the cylinder/piston assemblies and compressed natural gas flowing through the head. The water $W_1$ then exits the outlet 706.

As illustrated in FIG. 7C, the cylinders of the cylinder/piston assemblies 300, 302, 304, 306, and 308 are water jacketed. As shown, water $W_2$ enters an inlet 712 and flows around each cylinder of the cylinder piston assemblies 300, 302, 304, 306, and 308 to a outlets 714 and 715 (FIG. 7B). The water jacket carries heat away from the cylinders or compression chambers, the sources of heat due to the compression of the natural gas.

The heated water from the various cooling systems discussed above is generally sent through a water-air radiator where the water may be cooled for recirculation. The radiator may be a unit dedicated to the compressor, or the compressor may make use of the vehicle's own cooling system. For example, the heated water may be circulated through the vehicle's radiator and returned to the compressor bypassing the engine block, thermostat, and water pump.

As illustrated in FIGS. 7A-7C, the compact, planar, in-line arrangement of the cylinder head 220 brings the cylinder valves closer to the pistons thus reducing the gas flow paths and dead-volume in the system and maintaining gas flow through the compressor 204. This layout is possible through the use of the water cooling systems above by eliminating the need for large fins on individual heads separated by an air gap. The arrangement of the cylinder head 220 also maximizes the surface area of the intercooler. The volumetric specific heat of water is 4200 times greater than air allowing the compressor package to be reduced in size while maintaining thermal performance. Water cooling also allows cooling to be directed where needed which reduces the thermal gain on various components such as seals, cylinder walls, valves, and plumbing. This has the benefit of allowing for densification of the gas for a more complete fueling of the vehicle, while reducing the wear on seals and other rubbed surfaces. As the water-cooling has intimate contact with the cylinder walls, the temperature-controlled environment further prolongs the life of the seals.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "connector", "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A natural gas compressor, comprising:

a housing;

a plurality of cylinder piston assemblies disposed within the housing, each assembly comprising a non-lubricated piston for compressing natural gas within a cylinder of the assembly, wherein the plurality of cylinder piston assemblies are fluidly connected in sequence such that each assembly forms a compression stage of the compressor; and a drive system for moving the pistons of the cylinder piston assemblies to compress natural gas within the cylinders of the assemblies, wherein the drive system comprises a drive shaft and, for each assembly: an eccentric connected to the drive shaft and a connecting rod, wherein the rotation of the drive shaft rotates the eccentric and oscillates the connecting rod; a driving member connected to the connecting rod, wherein oscillation of the connecting rod oscillates the driving member; a pivoting member connecting the driving member to the housing, wherein the driving member pivots about the pivoting member; and a piston push rod connected to the driving member and engaging the piston of the assembly, wherein oscillation of the driving member moves the piston to compress natural gas within the cylinder of the assembly; and wherein each driving member is connected to the corresponding piston push rod by a connection; and each piston push rod is supported by upper and lower bushings, the upper bushing located above the connection of the driving member and the lower bushing located below the connection of the driving member.

2. The compressor of claim 1, wherein the compressor is sized and configured for use in a vehicle.

3. The compressor of claim 1, wherein the pressure of compressed natural gas exiting the last cylinder piston assembly of the compressor is between 2000 and 5000 psi when the drive shaft of the drive system is rotating between 50 and 500 RPM.

4. The compressor of claim 1, wherein the pistons of the cylinder piston assemblies and the piston push rods of the drive system comprise organic seals.

5. The compressor of claim 1, wherein each driving member of the drive system is connected on opposite sides of the corresponding piston push rod.

6. The compressor of claim 1, wherein the upper and lower bushings are greater than 1½ inches apart.

7. The compressor of claim 1 further comprising at least one cylinder head secured to the housing and comprising a plurality of cylinder head conduits that fluidly connect the cylinder piston assemblies.

8. The compressor of claim 7 further comprising an intercooler that cools the natural gas between the compression stages of the compressor, wherein the intercooler comprises a tank and a plurality of intercooler conduits in fluid communication with the cylinder head conduits.

9. The compressor of claim 1 further comprising a water jacket having at least one conduit that cools the cylinder piston assemblies of the compressor.

10. The compressor of claim 1, wherein the compressor has five cylinder piston assemblies forming five compression stages of the compressor, and wherein: the pressure velocity (PV) values for the compression stages range between 1800 psi*ft/min and 150000 psi*ft/min; the outlet pressures for the compression stages range between 30 psig and 3600 psig; the diameters of the cylinder piston assemblies range between ¼ inch and 5 inches; and the volumes of the cylinder piston assemblies range between ¼ $in^2$ and 12 $in^2$.

11. The compressor of claim 1, wherein at least one of the cylinder piston assemblies comprises stacked seals between the piston and cylinder of the assembly.

12. The compressor of claim 11, wherein the stacked seals are U-cup shaped seals with alternating layers of sealing material.

13. The compressor of claim 1, wherein the compressor is configured to recirculate natural gas that has blown by the pistons of the cylinder piston assemblies.

14. The compressor of claim 1, wherein the pressure of compressed natural gas exiting the last cylinder piston assembly of the compressor is 3600 psi when the drive shaft is rotating at 200 RPM.

15. The compressor of claim 1 further comprising
a motor and
a torque multiplier connected to the motor, wherein the drive shaft of the drive system is connected to the torque multiplier.

16. The compressor of claim 15, wherein the compressor is sized such that it occupies no more than 8000 $in^3$.

17. The compressor of claim 15, wherein the compressor is sized such that its dimensions are not greater than 14 in×14 in×36 in.

18. The compressor of claim 15, wherein the pressure of compressed natural gas exiting the last cylinder piston assembly of the compressor is between 2000 and 5000 psi when the drive shaft of the drive system is rotating between 50 and 500 RPM.

19. The compressor of claim 18 further comprising at least one cylinder head secured to the housing and comprising a plurality of conduits that fluidly connect the cylinder piston assemblies.

20. The compressor of claim 15, wherein: the pistons of the cylinder piston assemblies and the piston push rods of the drive system comprise organic seals; each driving member of the drive system is connected on opposite sides of the corresponding piston push rod by a connection; and each piston push rod of the drive system is supported by upper and lower bushings, the upper bushing located above the connection of the driving member and the lower bushing located below the connection of the driving member.

21. The compressor of claim 1 further comprising a compressed natural gas storage tank fluidly connected to the natural gas compressor.

22. The compressor of claim 21, wherein the compressor is sized such that it occupies no more than 35,000 $in^3$.

23. The compressor of claim 21, wherein the compressor is sized such that its dimensions are not greater than 48 in×35 in ×20.5 in.

24. The compressor of claim 21 further comprising a water recirculation system having a water pump and a radiator.

25. The compressor of claim 15 further comprising an intercooler that cools the natural gas between the compression stages of the compressor, wherein the intercooler comprises a plurality of conduits in fluid communication with the cylinder piston assemblies.

26. The compressor of claim 1, wherein the compressor has a capacity of between 2 and 3 Gasoline Gallon Equivalent of compressed natural gas per hour.

27. A natural gas compressor for a vehicle, comprising: a housing; a plurality of cylinder piston assemblies disposed within the housing, each assembly comprising a piston for compressing natural gas within a cylinder of the assembly, wherein the plurality of cylinder piston assemblies are fluidly connected in sequence such that each assembly forms a compression stage of the compressor; a water jacket having at least one conduit that cools the cylinder piston assemblies; at least one cylinder head secured to the housing and comprising a plurality of cylinder head conduits that fluidly connect the cylinder piston assemblies; and a drive system for moving the pistons of the cylinder piston assemblies to compress natural gas within the cylinders of the assemblies, wherein the drive system comprises a drive shaft and, for each assembly: an eccentric connected to the drive shaft and a connecting rod, wherein the rotation of the drive shaft rotates the eccentric and oscillates the connecting rod; a driving member connected to the connecting rod, wherein oscillation of the connecting rod oscillates the driving member; a pivoting member connecting the driving member to the housing, wherein the driving member pivots about the pivoting member; and a piston push rod connected to the driving member and engaging the piston of the assembly, wherein oscillation of the driving member moves the piston to compress natural gas within the cylinder of the assembly; and wherein: the pistons of the cylinder piston assemblies and the piston push rods of the drive system comprise organic seals; each driving member of the drive system is connected to the corresponding piston push rod by a connection; and each piston push rod of the drive system is supported by upper and lower bushings, the upper bushing located above the connection of the driving member and the lower bushing located below the connection of the driving member.

* * * * *

UNITED STATES PATENT AND TRADEMARK OFFICE

CERTIFICATE OF CORRECTION

PATENT NO. : 9,279,420 B2
APPLICATION NO. : 14/290344
DATED : March 8, 2016
INVENTOR(S) : Dan T. Moore et al.

It is certified that error appears in the above-identified patent and that said Letters Patent is hereby corrected as shown below:

In the claims:

Column 16, claim 26, line 7, after the word between, delete "2" and replace it with --1/2--.

Signed and Sealed this
Twenty-fourth Day of May, 2016

Michelle K. Lee

Michelle K. Lee
*Director of the United States Patent and Trademark Office*